US011471749B2

(12) United States Patent
Karsky

(10) Patent No.: US 11,471,749 B2
(45) Date of Patent: Oct. 18, 2022

(54) COLLAPSIBLE STUNT RAMP APPARATUS

(71) Applicant: Joseph Karsky, Sauk Rapids, MN (US)

(72) Inventor: Joseph Karsky, Sauk Rapids, MN (US)

( * ) Notice: Subject to any disclaimer, the term of this patent is extended or adjusted under 35 U.S.C. 154(b) by 15 days.

(21) Appl. No.: 17/351,626

(22) Filed: Jun. 18, 2021

(65) Prior Publication Data

US 2021/0394041 A1 Dec. 23, 2021

Related U.S. Application Data

(60) Provisional application No. 63/041,239, filed on Jun. 19, 2020.

(51) Int. Cl.
*A63C 19/10* (2006.01)
*A63H 18/02* (2006.01)

(52) U.S. Cl.
CPC ..... *A63C 19/10* (2013.01); *A63C 2203/10* (2013.01)

(58) Field of Classification Search
CPC ..... A63C 19/00; A63C 19/10; A63H 18/00; A63H 18/02; A61G 3/061; A61G 5/104
USPC ..... 472/87–90; 14/69.5
See application file for complete search history.

(56) References Cited

U.S. PATENT DOCUMENTS 4,129,916 A * 12/1978 Schlesinger ..... E01C 13/003 404/1
7,225,492 B2 6/2007 Pratt
7,261,614 B2 8/2007 Laurienzo et al.
8,448,278 B1 * 5/2013 Beilstein ..... B65G 69/30 414/537
2002/0108190 A1 8/2002 Martinez
2011/0021110 A1 1/2011 Hippely et al.
2014/0150188 A1 * 6/2014 Allen ..... E04F 11/1865 256/65.03
2017/0043240 A1 2/2017 Gee

* cited by examiner

*Primary Examiner* — Kien T Nguyen
(74) *Attorney, Agent, or Firm* — Boudwin Intellectual Property; Daniel Boudwin

(57) ABSTRACT

A collapsible stunt ramp apparatus is provided. The collapsible stunt ramp apparatus includes a base support structure and a number of base support rods. The base support structure includes a number of slots. The slots are designed to receive the base support rods. The collapsible stunt ramp apparatus also includes a number of vertical support beams. The number of vertical support beams includes a pair of intermediate support beams that are designed to connect to the base support rods. The collapsible stunt ramp apparatus also includes a ramp platform. The ramp platform is designed to connect to the vertical support beams.

12 Claims, 5 Drawing Sheets

COLLAPSIBLE STUNT RAMP APPARATUS

CROSS REFERENCE TO RELATED APPLICATIONS

This application claims the benefit of U.S. Provisional Application No. 63/041,239 filed on Jun. 19, 2020. The above identified patent application is herein incorporated by reference in its entirety to provide continuity of disclosure.

BACKGROUND OF THE INVENTION

The present invention relates to a collapsible stunt ramp apparatus. More specifically the present invention provides a stunt ramp that can be assembled and disassembled easily while including a self-containable storage mechanism.

Many individuals purchase and enjoy remote-controlled (RC) vehicles for recreational use or as a hobby. These individuals may drive their RC vehicles around parks or roads to relax or may race them against other RC vehicles in competitions. Eventually, controlling RC vehicles on flat terrain may become repetitive or boring. In some cases, the lack of exciting terrain may cause one to lose interest in RC vehicles all together.

Modifying an existing property to improve the terrain for RC vehicles, such as by installing tracks, ramps, jumps or other obstacles, may improve the enjoyment. However, such work can be expensive and may render the property unsuitable for other uses. Installing these features can also be expensive and have a negative long-term impact on the natural terrain. A lot of these materials may also be heavy, bulky or difficult to transport. Therefore, there is a defined need amongst the known prior art references for an apparatus that is easy to assemble, disassemble, store and transport that will increase the enjoyment of RC vehicles or the like.

SUMMARY OF THE INVENTION

In view of the foregoing disadvantages inherent in the known types of RC vehicle terrain enhancement devices and methods now present in the prior art, the present invention provides a collapsible stunt ramp apparatus wherein the same can be utilized for providing convenience for the user when enhancing terrain for use with RC vehicles.

The present system comprises a collapsible stunt ramp apparatus. The collapsible stunt ramp apparatus comprises a base support structure and a plurality of base support rods. The base support structure comprises a plurality of slots configured to receive the plurality of base support rods. Additionally, the collapsible stunt ramp apparatus comprises a plurality of vertical support beams. A pair of intermediate vertical support beams of the plurality of vertical support beams are configured to engaged the plurality of base support rods. Furthermore, the collapsible stunt ramp apparatus comprises a ramp platform. The ramp platform is configured to engage a plurality of distal ends of the plurality of vertical support beams

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
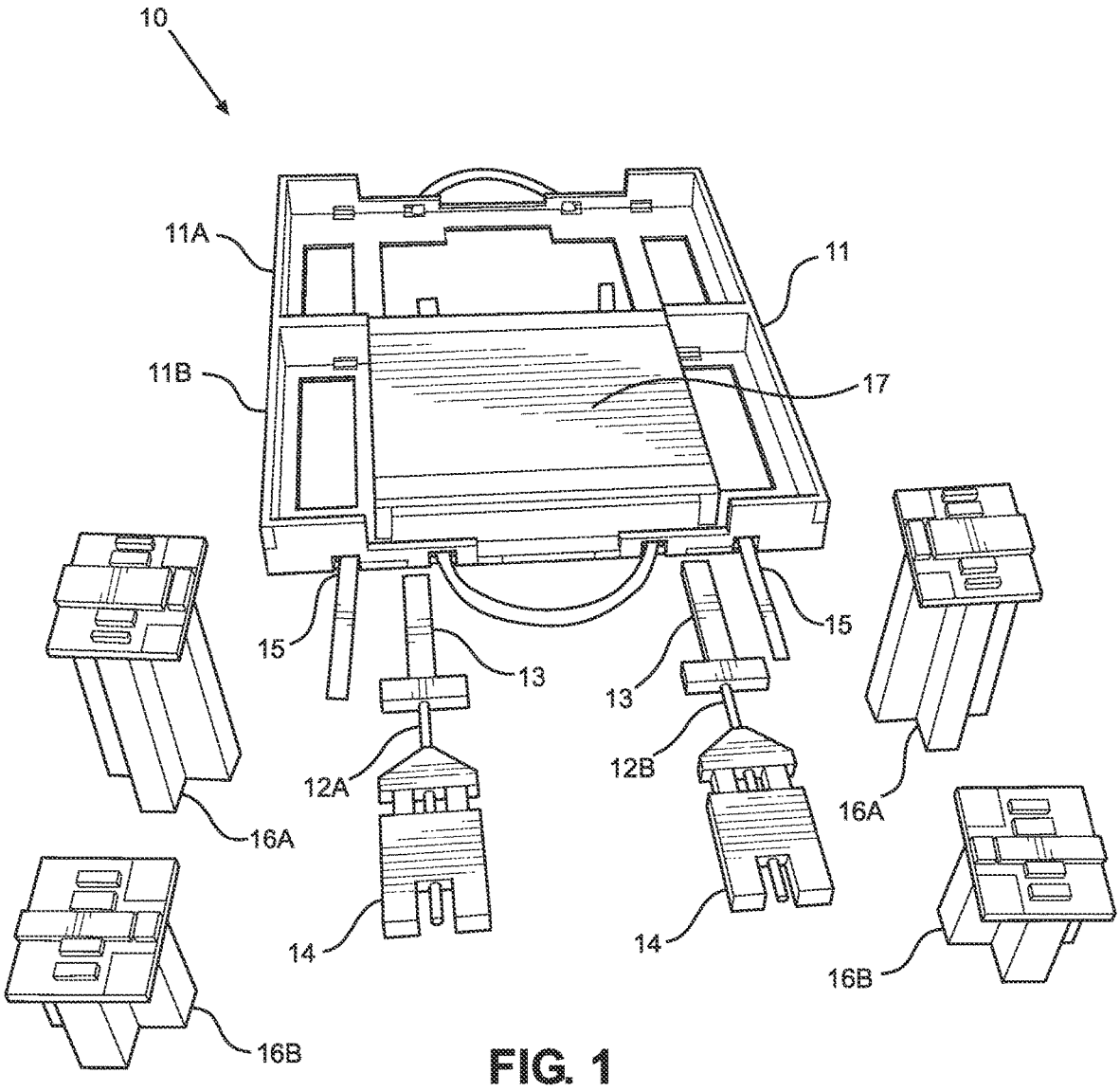
FIG. 1 shows a perspective view of an embodiment of the collapsible stunt ramp apparatus a disassembled state.

Reference is made herein to the attached drawings. Like reference numerals are used throughout the drawings to depict like or similar elements of the collapsible stunt ramp apparatus. The figures are intended for representative purposes only and should not be considered to be limiting in any respect.

Referring now to FIG. 1, there is shown a perspective view of an embodiment of the collapsible stunt ramp apparatus in a disassembled state. The collapsible stunt ramp apparatus 10 comprises a base support structure 11. The base support structure 11 provides dual-functionality as both a structural base for the collapsible ramp apparatus 10 in the assembled configuration (shown in FIG. 3) and a storage housing for the collapsible ramp apparatus 10 in the stored configuration (shown in FIG. 5). In the illustrated embodiment, the base support structure 11 comprises a pair of base platforms 11*a*, 11*b* hingedly affixed to each other and defining a housing therebetween. The first base platform 11*a* and the second base platform 11*b* are symmetrical, such as to form a uniform housing.

The collapsible stunt ramp apparatus 10 further comprises a plurality of base support rods 12*a*, 12*b*. In the illustrated embodiment, collapsible stunt ramp apparatus comprises a pair of base support rods consisting of a first base support rod 12*a* and a second base support rod 12*b*. The plurality of base support rods 12*a*, 12*b* are configured to secure the base platform 11 to the other components of the collapsible stunt ramp apparatus 10. In the illustrated embodiment, each base support rod of the plurality of base support rods 12*a*, 12*b* comprises a first end 13 opposite a second end 14. The first end 13 of each base support rod 12*a*, 12*b* is configured to engage a slot 15 defined in the base support structure 11.

Additionally, the collapsible stunt ramp apparatus 10 comprises a plurality of vertical support beams 16*a*, 16*b*. The plurality of vertical support beams 16*a*, 16*b* are configured to provide vertical, structural support to the collapsible stunt ramp apparatus 10. In the illustrated embodiment, the plurality of vertical support beams 16*a*, 16*b* comprises a pair of intermediate vertical support beams 16*a* and a pair of distal vertical support beams 16*b*. The intermediate vertical support beams 16*a* are disposed at a closer distance to the base support structure than the distal vertical support beams 16*b*. The intermediate vertical support beams 16*a* are configured to engage the plurality of base support rods 12*a*, 12*b* (as shown in FIG. 2).

The collapsible stunt ramp apparatus 10 further comprises a ramp platform 17. The ramp platform 17 is designed to provide a surface on which an RC vehicle or other similar device, may traverse the collapsible stunt ramp apparatus 10. The ramp platform 17 of the illustrated embodiment is foldable, such as to be stowed in the base support structure 11. The ramp platform 17 is configured to engage the top ends of the plurality of vertical support beams 16*a*, 16*b*.

Figure 2:
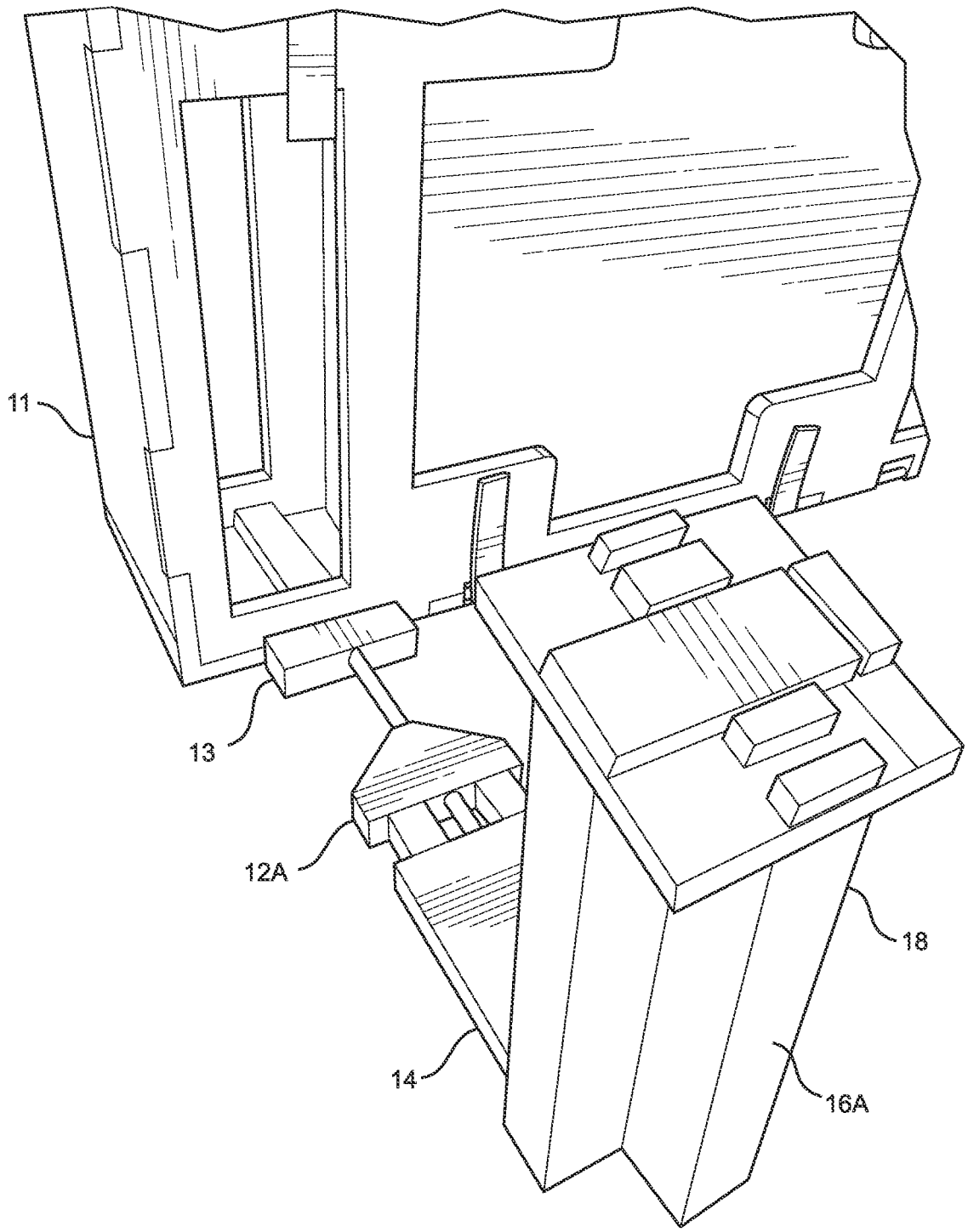
FIG. 2 shows a close-up perspective view of an embodiment of the collapsible stunt ramp apparatus.

Referring now to FIG. 2, there is shown a close-up perspective view of an embodiment of the collapsible stunt ramp apparatus. In the illustrated embodiment, the functional utility of the plurality of base support rods 12*a* is demonstrated. The base support rod 12*a* defines an interface on each of the first end 13 and the second end 14 of the base support rod 12*a*. The interface at the first end 13 of the base support rod 12*a* comprises an insertable structure dimensioned to extend through the slot (15 in FIG. 1) of the base support structure 11. The interface at the second end 14 of the base support rod 12*a* comprises a receptacle configured to receive a protrusion 18 of the vertical support beam 16*a*. Though the specific protrusion on the rear face of the vertical support beam 16*a* is not visible, the protrusion 18 of the front face of the vertical support beam 16*a* is identical is size, shape and configuration.

Figure 3:
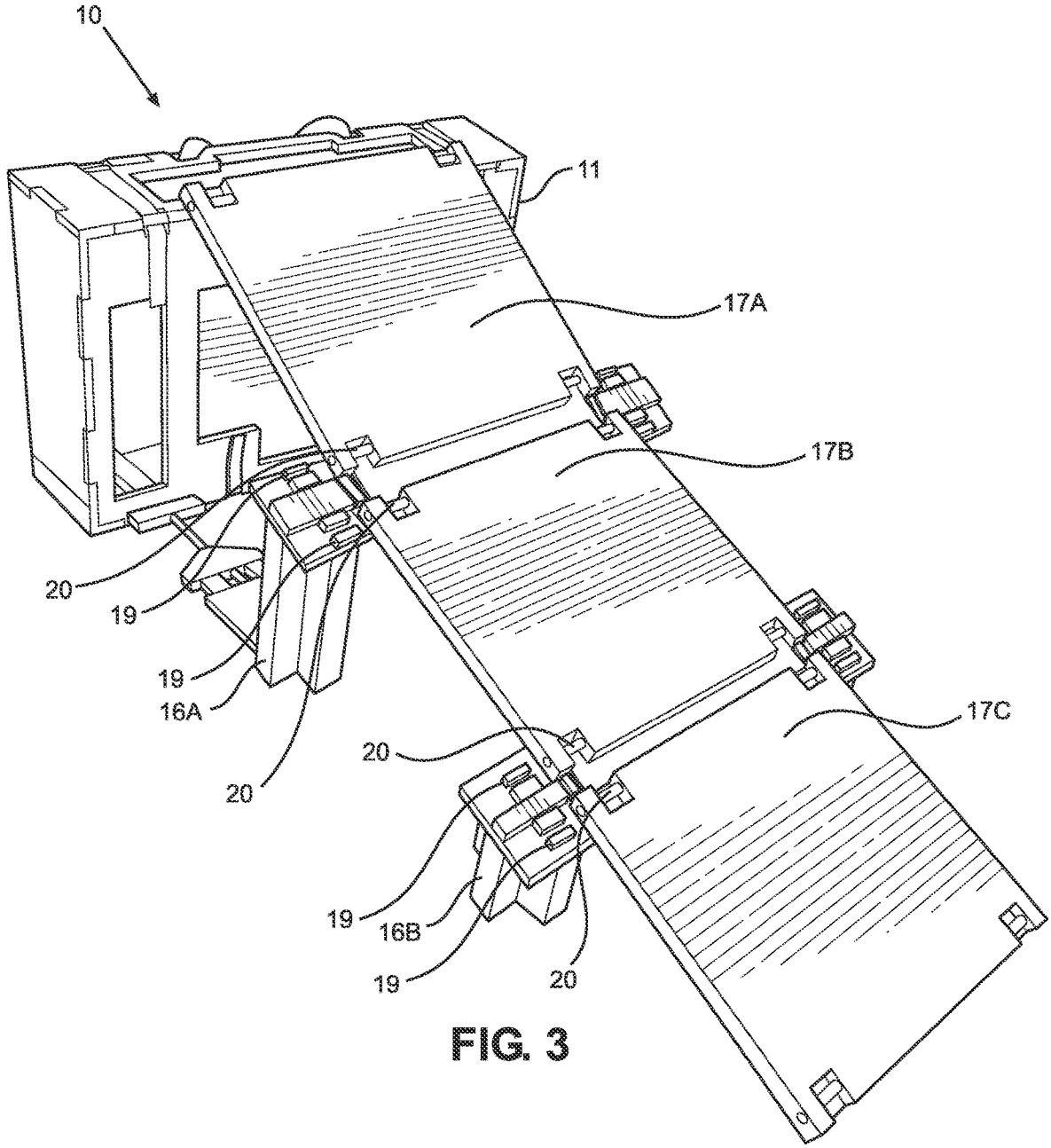
FIG. 3 shows a perspective view of an embodiment of the collapsible stunt ramp apparatus.

Referring now to FIG. 3, there is shown a perspective view of an embodiment of the collapsible stunt ramp apparatus. In the illustrated embodiment the ramp platform 17*a*, 17*b*, 17*c* is extended, such as to enable an RC vehicle, or similar device, to traverse the collapsible stunt ramp apparatus 10. In the specific embodiment, the ramp platform comprises a plurality of panels 17*a*, 17*b*, 17*c*. The plurality of panels 17*a*, 17*b*, 17*c* of the illustrated embodiment consists of a first panel 17*a*, a second panel 17*b* and a third panel 17*c*. The first panel 17*a* is attached, at a first end, to the base support structure 11 which is placed in a vertical position.

In the illustrated embodiment, each vertical support beam 16*a*, 16*b* comprises a plurality of channels 19. The plurality of channels 19 are disposed at a top end of each vertical support beam 16*a*, 16*b* and are dimensioned to receive at least one tab 20 therein. The plurality of tabs 20 are defined on the plurality of panels 17*a*, 17*b*, 17*c*. As such, the ramp platform 17*a*, 17*b*, 17*c* may be secured to the plurality of vertical support beams 16*a*, 16*b*, preventing the undesired collapse of the collapsible stunt ramp apparatus 10. In the Illustrated embodiment, the pair of intermediate vertical support beams 16*a* are of a greater height than the pair of distal vertical support beams 16*b*. As such, the ramp platform 17*a*, 17*b*, 17*c* will be positioned at an increasing elevation from the distal end of the ramp platform to the proximal end of the ramp platform.

Figure 4:
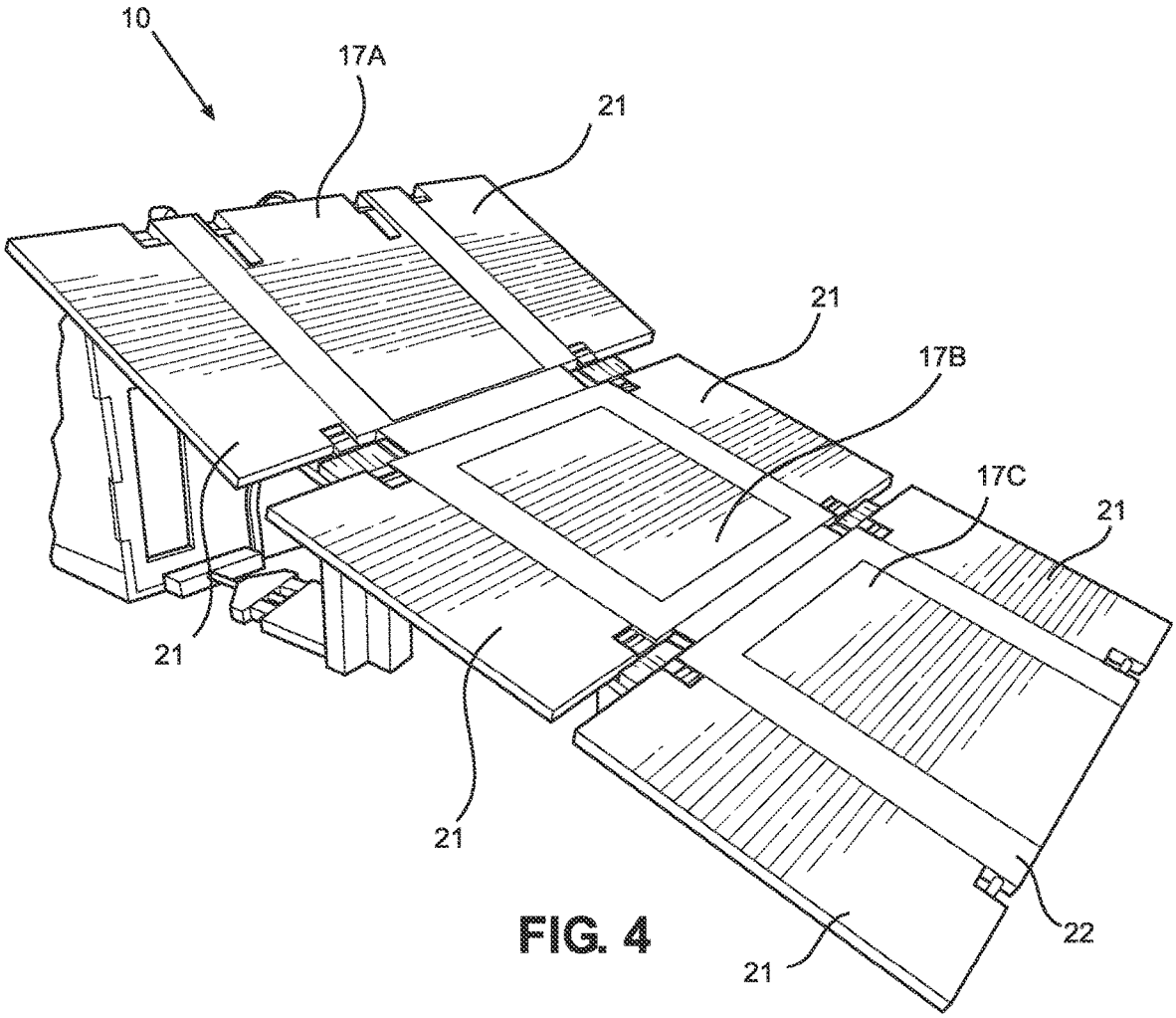
FIG. 4 shows a perspective view of an embodiment of the collapsible stunt ramp apparatus.

Referring now to FIG. 4, there is shown a perspective view of an embodiment of the collapsible stunt ramp apparatus. In the illustrated embodiment, the plurality of panels 17*a*, 17*b*, 17*c* of the ramp platform comprise a trifold configuration. In the trifold configuration, a pair of wings 21 are outwardly foldable from each panel of the plurality of panels 17*a*, 17*b*, 17*c*. As such, the surface area of the ramp platform can be increased, such as to accommodate larger RC vehicles or to improve navigation ability upon the collapsible stunt ramp apparatus 10. Furthermore, in the demonstrated embodiment, the collapsible stunt ramp apparatus 10 comprises a membrane 22. The membrane 22 is disposed over the seams defined by the plurality of panels 17*a*, 17*b*, 17*c*. The membrane 22 is configured to provide securement of the wings 21 to the plurality of panels 17*a*, 17*b*, 17*c* as well as to provide a smooth surface of the ramp platform.

Figure 5:
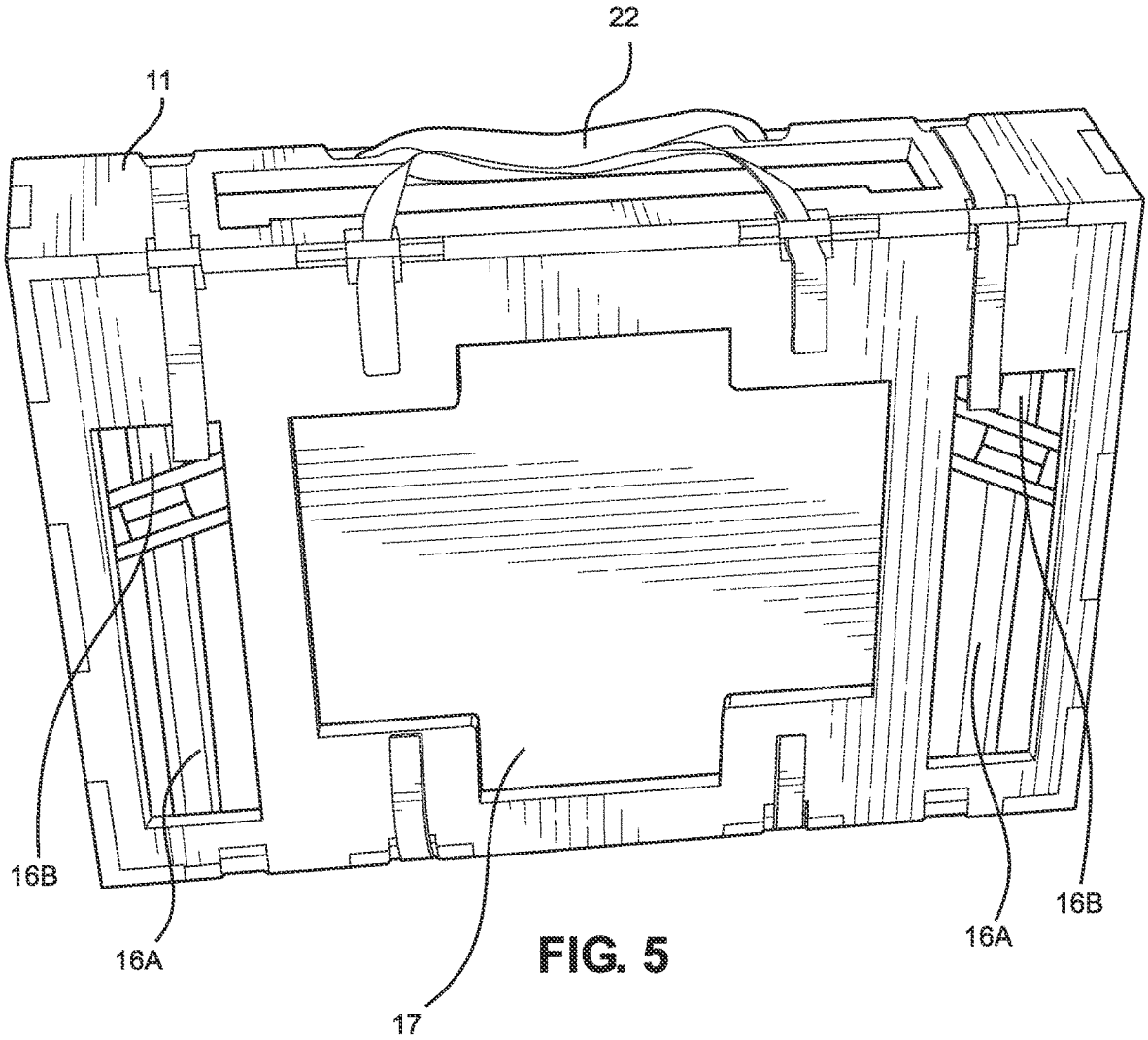
FIG. 5 shows a perspective view of an embodiment of the collapsible stunt ramp apparatus.

Referring now to FIG. 5, there is shown a perspective view of an embodiment of the collapsible stunt ramp apparatus. In the demonstrated embodiment, the housing formed by the base support structure 11 is placed into the closed configuration and contains the elements of the collapsible stunt ramp apparatus 10 therein. In the illustrated embodiment, the base support structure 11 housing defines an interior cavity dimensioned to receive the plurality of vertical support beams 16*a*, 16*b*, the plurality of base support rods, and the ramp platform 17 therein. Furthermore, in the illustrated embodiment, the base support structure 11 comprises a handle 23 to assist a user in transporting the collapsible stunt ramp apparatus 10.

It is therefore submitted that, the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible stunt ramp apparatus, comprising:

a base support structure;

a plurality of base support rods;

the base support structure comprising a plurality of slots configured to receive the plurality of base support rods;

a plurality of vertical support beams;

a pair of intermediate vertical support beams of the plurality of vertical support beams configured to engaged the plurality of base support rods;

a ramp platform;

the ramp platform configured to engage a plurality of distal ends of the plurality of vertical support beams.

2. The collapsible stunt ramp apparatus of claim 1, wherein the base support structure comprising a pair of base platforms hingedly affixed to each other and defining a housing therebetween.

3. The collapsible stunt ramp apparatus of claim 2, wherein the housing defines an interior cavity configured to receive the plurality of vertical support beams, the plurality of base support rods, and the ramp platform therein.

4. The collapsible stunt ramp apparatus of claim 1, wherein the base support structure comprises a handle.

5. The collapsible stunt ramp apparatus of claim 1, wherein the plurality of base support rods comprise a plurality of receptacles configured to receive a plurality of protrusions of the plurality of vertical support beams.

6. The collapsible stunt ramp apparatus of claim 1, wherein each vertical support beam of the plurality of vertical support beams comprises a plurality of channels on a top end thereof.

7. The collapsible stunt ramp apparatus of claim 1, wherein the plurality of vertical support beams comprises the pair of intermediate vertical support beams and a pair of distal vertical support beams.

8. The collapsible stunt ramp apparatus of claim 7, wherein the pair of intermediate vertical support beams is of a greater height than the pair of distal vertical support beams.

9. The collapsible stunt ramp apparatus of claim 1, wherein the ramp platform comprises a plurality of panels, the plurality of panels configured to be foldable over one another.

10. The collapsible stunt ramp apparatus of claim 9, wherein the plurality of panels defined a plurality of tabs on a top end and a bottom end thereof, the plurality of tabs configured to engage a plurality of channels defined by the plurality of vertical support beams.

11. The collapsible stunt ramp apparatus of claim 9, further comprising a membrane removably securable between the plurality of panels.

12. A collapsible stunt ramp apparatus, comprising:

a base support structure;

a plurality of base support rods;

the base support structure comprising a plurality of slots;

wherein the plurality of slots is configured to receive a plurality of protrusions of the plurality of vertical support beams a plurality of vertical support beams;

a pair of intermediate vertical support beams of the plurality of vertical support beams configured to engaged the plurality of base support rods;

wherein each vertical support beam of the plurality of vertical support beams comprises a plurality of channels on a top end thereof;

a ramp platform;

the ramp platform configured to engage a plurality of distal ends of the plurality of vertical support beams;

the base support structure comprising a pair of base platforms hingedly affixed to each other and defining a housing therebetween;

wherein the ramp platform comprises a plurality of panels, the plurality of panels configured to be foldable over one another;

wherein the plurality of panels defined a plurality of tabs on a top end and a bottom end thereof, the plurality of tabs configured to engage the plurality of channels defined by the plurality of vertical support beams.

* * * * *